United States Patent [19]

Acquaviva et al.

[11] Patent Number: 4,786,041

[45] Date of Patent: Nov. 22, 1988

[54] DOCUMENT HANDLER JAM CLEARANCE AND JOB RECOVERY SYSTEM

[75] Inventors: Thomas Acquaviva, Penfield; Michael B. Tanaka, Rochester; Charles E. Smith, Pittsford, all of N.Y.

[73] Assignee: Xerox Corporation, Stamford, Conn.

[21] Appl. No.: 117,762

[22] Filed: Nov. 6, 1987

[51] Int. Cl.[4] ..... B65H 7/06

[52] U.S. Cl. ..... 271/3.1; 271/9; 271/259; 271/263; 355/14 SH

[58] Field of Search ..... 271/3.1, 9, 259, 263, 271/291, 301, 902; 355/14 SH

[56] References Cited

U.S. PATENT DOCUMENTS

| | | | |
|---|---|---|---|
| 3,674,363 | 7/1972 | Baller et al. | 355/14 |
| 3,819,266 | 6/1974 | Price | 355/64 |
| 3,927,878 | 12/1975 | Bolsenga et al. | 271/173 |
| 3,999,851 | 12/1976 | Sakamaki et al. | 355/14 |
| 4,093,372 | 6/1978 | Guenther | 355/50 |
| 4,157,822 | 6/1979 | Miller | 271/3.1 |
| 4,231,567 | 11/1980 | Ziehm | 271/259 |
| 4,264,187 | 4/1981 | Rhodes, Jr. | 355/14 SH |
| 4,332,462 | 6/1982 | Yagasaki et al. | 355/14 R |
| 4,338,023 | 7/1982 | McGibben | 355/14 SH |
| 4,372,673 | 2/1983 | Tomosada et al. | 355/14 R |
| 4,384,712 | 5/1983 | Miyamoto | 271/263 X |
| 4,421,404 | 12/1983 | Conly | 355/14 CU |
| 4,452,525 | 6/1984 | Ogura | 355/14 R |
| 4,457,506 | 7/1984 | Ashbee et al. | 271/3.1 |
| 4,579,444 | 4/1986 | Pickney et al. | 355/14 SH |
| 4,639,125 | 1/1987 | Okuda | 271/3.1 X |
| 4,737,820 | 4/1988 | Murray | 355/14 SH |

OTHER PUBLICATIONS

Reid et al., U.S. Defense Pub. No. T957,006, Apr. 77.

*Primary Examiner*—Richard A. Schacher

[57] ABSTRACT

In a copying system utilizing a recirculating document handler (RDH) presenting documents to the platen of a copier for copying, with an RDH document stacking tray and an additional document input directly to the platen, and a three zone distributed drives feeding system for first feeding the documents from the stacking tray to the platen, secondly feeding the documents over the platen for copying, and thirdly feeding the documents from the platen back to the stacking tray after they have been copied, to normally form a complete document recirculation path, and sensors for sensing document jams and the position of jammed documents in the document paths connecting with a control system controlling the RDH, including stopping the RDH in response to sensing a jam and determining which documents have been copied before a jam and providing instructional displays to the operator for operator jam clearance (document removal) and job recovery; an improved jam clearance and job recovery system determining whether a document has resulted in a jammed document being present in a first, second, or third document path jam zone, corresponding to the three distributed drive zones, and automatically providing a preliminary job recovery operation before the RDH is fully stopped, by correspondingly selectably independently operating the document feeding zones to feed unjammed documents in the third jam zone to the stacking tray or feed unjammed documents in the first jam zone to the platen, so that documents are directerd to be operator removed from only one zone, if any. The operator is variably display instructed to place these removed documents either face up in the stacking tray, or face down in the separate document input, depending on the jam detection position and document removal position and copier operating condition, and the copier is restarted for job completion without manual document reordering.

7 Claims, 1 Drawing Sheet

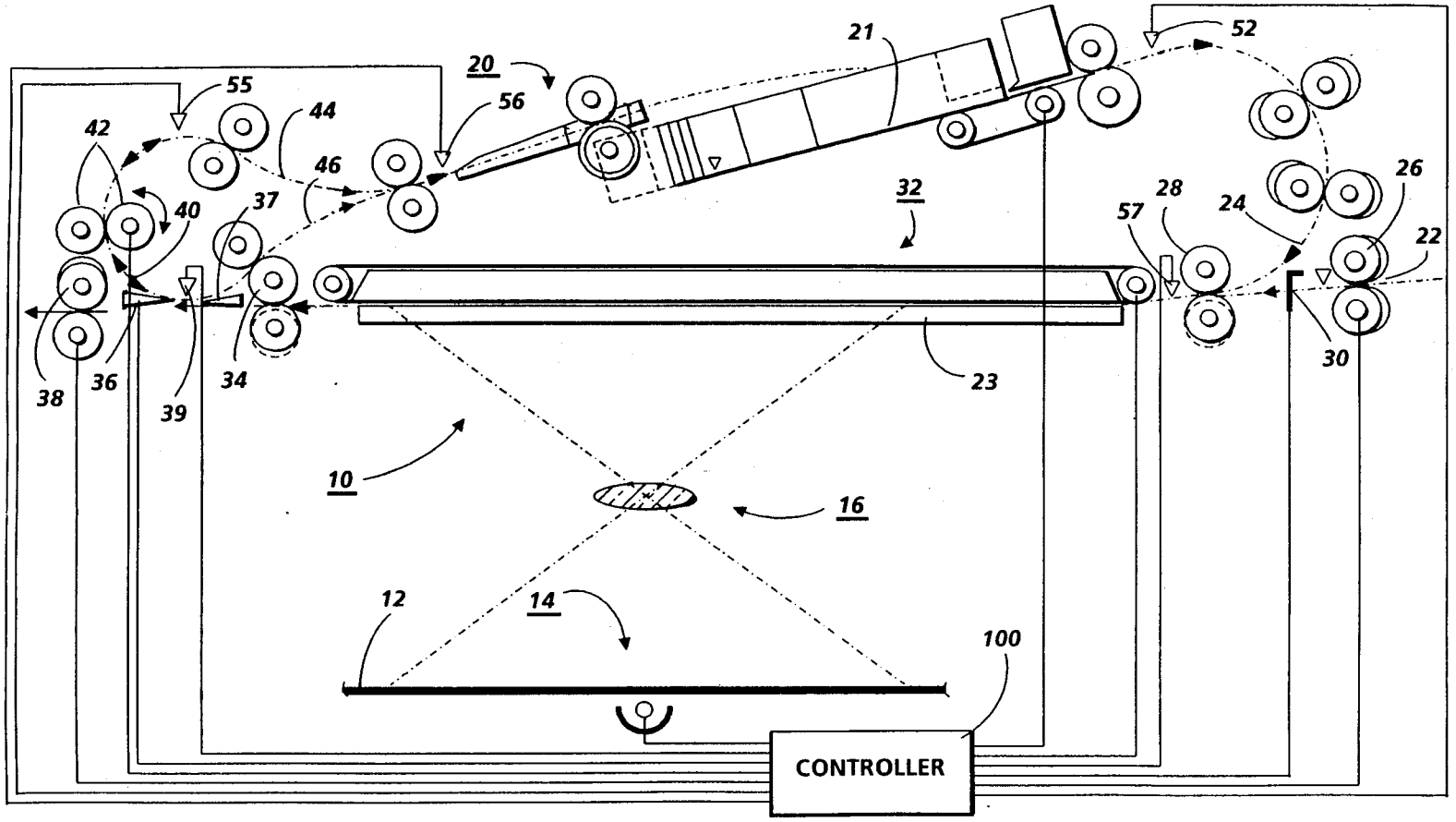
CONTROLLER
100
10
12
14
16
20
21
22
23
24
26
28
30
32
34
36
37
38
39
40
42
44
46
52
55
56
57

DOCUMENT HANDLER JAM CLEARANCE AND JOB RECOVERY SYSTEM

Hereby cross-referenced, and incorporated by reference, is the copending application of the same assignee, U.S. Ser. No. 029,027, entitled "Automatic Dual Mode Sheet and Web Document Transport For Copiers" Filed Mar. 23, 1987 by the same Thomas Acquaviva (sole) (Attorney Docket No. D/86036).

The present invention relates to copier document handling, and, more particularly, to document jam clearance and job recovery in an automatic document handling system.

In view of known difficulties in automatic document handling systems, further discussed hereinbelow, document jam detection, document jam clearance and copy sheet job recovery from document jams have have become increasingly critical and important, especially with current increases in document handling speeds. These difficulties include the criticality of document registration, wide variations in document conditions and dimensions, and the need for increased automation and operator simplification. There also remains a continued need for protection of valuable or delicate originals.

Document jams which must be detected and recovered from include slow feeds (documents late to registration) as well as misfeeds or non-feeds and skewed feeds or the like. These jams can occur at any point in the document path in the circulation of the documents, including in the inverter of a duplex document handler. Recirculating document handlers (RDH's), for providing precollated copy sets, are particularly critical in this regard because of the greatly increased number of document feeds for all the recirculations of the document set. Likewise job recovery is more difficult, since both the document set, and the copy set being made during the circulation of that document set, must be maintained or restored to the proper page order such that both that copy set and the subsequent copy sets will be properly collated.

Jam recovery and associated job recovery in many present copiers with document handlers requires the removal of documents stopped in several places in the document handler (even if the jam occured in only one location to only one document), and the manual reordering of the entire document set back to the original order, and the manual restacking of the manually reordered document set back in the document handler tray, and the removal and throwing away of some or all of the copies previously made in the document set circulation in which the jam occured.

Furthermore, existing RDH job recovery often requires recirculating the entire set of documents in the RDH throught the RDH loop circulation path without copying (known as a slew cycle) after a jam to return the proper document to be copied next for proper job recovery (job integrity) especially to maintain proper job collation. Examples are cited below. This is to accomplish removal and return of the proper documents to the proper sequence and position for restarting copying and continuing document feeding automatically.

It is known for copy sheets to provide a "cluster jam" system of continuing to run sheet feeders after a jam in unjammed areas of a copy sheet path of a copier so as to move unjammed sheets downstream of a jam point to an output tray, and to move other sheets to other suitable jam clearance cites, rather than leaving all the sheets in the path at their original positions when a jam occurs. Art of particular interest thereto is the basic Xerox Corporation U.S. Pat. No. 4,231,567 issued Nov. 4, 1980 to R. T. Ziehm. An example of details of a copy sheet job recovery system for a copier with an RDH is disclosed in U.S. Pat. No. 4,338,023 issued July 6, 1982 to G. M. McGibbon, and art cited therein.

Xerox Corporation U.S. Pat. No. 3,819,266 issued June 25, 1974 to H. C. Price is noted for a jam protection system inhibiting restarting except for recycling the document handler. Reid U.S. Defensive Publication No. T957,006, published Apr. 5, 1977 by M. G. Reid et al, is noted for its system of automatically rearranging documents in a recirculating feeder when a malfunction, such as a paper jam, has occurred in the feeder or in the copier.

Art of particular interest especially to the providing of a recirculating document handler with separate drives of separate portions of the document path includes Xerox Corporation U.S. Pat. No. 4,093,372 issued June 9, 1978 to J. Guenther; and IBM Corp. U.S. Pat. No. 4,457,506 issued July 3, 1984 to W. H. Ashbee et al. A non-recirculating document handler with separate drives is taught in FX/17293N filed Oct. 11, 1986 as Japanese App. No. 60-224643, Kokai (laid open) No. 62-85232, laid open Apr. 18, 1987.

IBM Corp. U.S. Pat. No. 4,421,404 issued Dec. 20, 1983 to D. J. Conly, on job recovery in a copier with document feeder is of particular interest as disclosing an automatic document feeder (ADF) combined with a semiautomatic document feeder (SADF), where the originals needed for recopying after a jam are fed through the SADF, and once the jam recovery is complete automatic restarting of the ADF occurrs.

Other references noted by way of background to the jam clearance and job recovery system disclosed herein include U.S. Pat. Nos. 3,674,363; 3,927,878; 3,999,851; 4,157,822; 4,264,187; 4,332,462; 4,372,673; and 4,452,525. Additional such related patents are cited hereinbelow in connection with control system patents.

Also of particular interest here are dual mode recirculating document handlers with a separate or SADH document input, i. e., RDH/SADH document handlers. Examples are disclosed in Xerox Corporation U.S. Pat. Nos. 4,579,444 issued Apr. 1, 1986 to T. S. Pinckney and H. J. Sanchez (D/84074); or Eastman Kodak 4,192,607 issued Mar. 11, 1980 to C. T. Hage, and 4,350,329 issued Sept. 21, 1982 to R. C. Holzhauser et al, and 4,176,945 issued Dec. 4, 1979 to R. Holzhauser.

As xerographic and other copiers increase in speed, and become more automatic, it is increasingly important to provide higher speed yet more reliable and more automatic handling of the document sheets being copied, i.e. the input to the copier. It is desirable to feed, accurately register, and copy document sheets of a variety or mixture of sizes, types, weights, materials, conditions and susceptibility to damage, yet with minimal document jamming, wear or damage by the document transporting and registration apparatus, even if the same documents are automatically fed and registered repeatedly, as for recirculating document precollation copying.

The art of original document sheet handling for copiers has been intensively pursued in recent years. Various systems have been provided for automatic or semiautomatic feeding of document sheets to and over the imaging station of the copier for copying. The documents are normally fed over the surface of an imaging station comprising a transparent platen, into a registered copying position on the platen, and then off the platen. Such automatic or semiautomatic document handlers eliminate the need for the operator to place and align each document on the platen by hand. This is a highly desirable feature for copiers. Document handlers can automatically feed documents as fast as they can be copied, which cannot be done manually with higher speed copiers, thus enabling the full utilization or productivity of higher speed copiers.

A preferable document handling system is one that utilizes an existing or generally conventional copier optical imaging system, including the external transparent copying window (known as the platen or imaging station) of the copier. It is also desirable that the document handling system be readily removable, as by pivoting away, to alternatively allow the copier operator to conventionally manually place documents, including books, on the same copying platen. Thus, a lighter weight document handler is desirable. It is also desirable that a document registration edge alignment or positioning system be available for such manual copying which is compatible with that used for the document handler.

Although faster, more accurate, and automatic feeding into and registration of each document at the correct position on the platen to be copied is highly desired, this is difficult to accomplish without document jams or skewing (rotating) the document and/or damaging the edge of the document, particularly as it is being stopped. One problem is that documents can vary widely in sheet size, weight, thickness, material, condition, humidity, age, etc. Documents may even have curls, wrinkles, tears, "dog-ears", cut-outs, overlays, tape, paste-ups, punched holes, staples, adhesive or slippery areas, or other irregularities. Unlike sets of copy sheets, which generally are all from the same new clean batches and therefore of almost exactly the same condition and size, documents often vary considerably even if they are all of the same "standard" size, (e.g. letter size, legal size, A4, B4, etc.). In contrast, documents even in the same set may have come from completely different paper batches or have variably changed size with different age or humidity conditions, etc. Furthermore, the images on documents and their fusing can change the sheet feeding characteristics and these images may be subject to damage in feeding if not properly handled, e.g. smearing of fresh typewriting ink. Yet it is desirable to automatically or semiautomatically rapidly feed, register and copy even a mixture of sizes, types, and conditions of documents without document jams or document damage and with each document correctly and accurately aligned to a desired registration position.

One of the most difficult to achieve features for automatic document handling is the rapid, accurate, reliable, and safe registration of each document at the proper position for copying. Conventionally the document is desirably either center registered or corner registered (depending on the copier) by the document handler automatically at a preset registration position relative to the copier platen. At this registration position two orthogonal edges of the document are aligned with two physical or positional (imaginary) registration lines of the copier platen at which the original document is properly aligned with the copier optics and copy sheet/photoreceptor registration system for correct image transfer of the document image to the photoreceptor and then to the copy sheet. This registration accuracy is desirably consistently within approximately one millimeter. If the document is not properly registered, then undesirable dark borders and/or edge shadow images may appear on the ensuing copy sheet, or information near an edge of the document may be lost, i.e. not copied onto the copy sheet. Document misregistration, especially skewing, can also adversely affect further feeding and/or restacking of the documents.

A misregistration or abnormally slow feeding or velocity change of a document can be sensed by known document sensors in the document path to provide a jam indication. I.e., document jams are not limited to only stuck or stopped documents.

In preferred types of copying systems the document is registered for copying overlying a selected portion of full sized (full frame) platen which is at least as large as the largest document to be normally copied automatically. In such systems the document is preferably either scanned or flashed while it is held stationary on the platen in the desired registration position. That is, in these full frame systems the document is preferably registered by being stopped and held during imaging at a preset position over the platen glass which is adjacent one side or edge thereof.

As shown in the art, and further discussed below, document handling systems have been provided with various document transports to move the documents over the copier platen and into registration. Such document platen transports may comprise single or plural transport belts or feed wheels, utilizing frictional, vacuum, or electrostatic sheet driving forces. Various combinations of such transports are known with various registration devices or systems. Preferably the same platen transport sheet feeder is used to drive a document onto and off of the platen before and after copying as well as registering the document.

The cited art shows several approaches to registering a document for copying at an appropriate position relative to the transparent copying window. Typically the document is registered on one axis by driving it with a platen transport against a mechanical gate or stop positioned temporarily or permanently at or adjacent one edge of the platen. This is often at or closely adjacent the downstream edge of the platen. That allows unidirectional movement of the document across the platen, entering from the upstream side or edge closely following the proceeding document and ejecting after copying from the downstream side or edge of the platen. The registration gate or stop may comprise projecting aligned fingers, or roller nips, or a single vertical surface along one registration line, against which an edge of the sheet, preferably the leading edge, is driven into abutment to mechanically stop and thereby register the sheet on one axis, in its principal direction of movement. Another function of such mechanical registration is to also deskew the document, i.e., to properly rotate and align it with this registration line as well as to determine and control its registration position. However, such a mechanical gate cannot be interposed in the path of a continuous web document and thus cannot be used for intemediate registration thereof.

As disclosed, for example, in U.S. Pat. Nos. 4,043,665 issued Aug. 23, 1977 to J. R. Caldwell; 4,132,401 issued Jan. 2, 1979 to J. F. Gauranski, et al; or 4,295,737 or 4,391,505 issued Oct. 20, 1981 and July 5, 1983 to Morton Silverberg, document registration can desirably be done without mechanical document stops on the platen. This can be done by preregistering the document to a platen transport belt and then moving the document a known, preset, distance over the platen on the belt into registration, providing there is no slippage during this entire movement between the document and the belt. Alternatively, this can be done by sensing, on the platen or upstream of the platen, with a document edge sensor, the edge of a document being transported onto the platen and then stopping the document platen transport then or after a preset time period or movement to stop the document on the platen. Off-platen document edge sensing (see below) is preferred, since reliable on-platen sensing is more difficult and generally requires special sensors and platen transport modifications or adaptations such as disclosed in said U.S. Pat. Nos. 4,391,505 and in 3,473,035 and 3,674,363. Thus, U.S. Pat. No. 3,674,363 to E. O. Baller et al, issued July 4, 1972, e.g. Cols. 8 and 9, second paragraph, and Col. 10, first paragraph, disclosing sensing the document trail edge upstream of the platen to initiate slowdown and stopping of the platen transport. Said U.S. Pat. No. 3,473,035, issued Oct. 14, 1969 to J. F. Gardner, is noted as to SW1 in FIG. 7 and its description re operator selectable document stopping/shifted imaging positions. A recent measured-stop registration system, for an RDH, is taught in U.S. Pat. No. 4,579,444 issued Apr. 1, 1986 to T. S. Pinckney and H. J. Sanchez (D/84074).

The following additional references also apparent sense a document sheet trailing edge as the reference time for initiating a control "count" or fixed distance drive for controlling the document sheet feeding drive on the copier platen: IBM Tech. Discl. Vol. 19, No. 5, Oct. 1976, pp. 1589–1591, and U.S. Pat. Nos. 3,829,083 and 3,936,041,. to Shiina et al (Ricoh), and 4,066,255 issued Jan. 3, 1978 to W. F. Bradbury (Addressograph-Multigraph Corp.), and Xerox Disclosure Journal publications Vol. 2, No. 3, May/June 1977, p. 49, and Vol. 3, No. 2, March/April 1978, pp. 123–124.

Further examples of U.S. Patents on servo-motor or stepper-motor driven original document feeders in general are U.S. Pat. Nos. 3,888,579; 4,000,943; 4,144,550; 4,283,773 and 4,455,018.

In some document handling systems a system for also side registering (laterally positioning) the document on the platen is used, i.e. aligning the original on both axes while on the platen, e.g. U.S. Pat. Nos. 4,411,418 or 4,335,954. However two axes on-platen registration is not required, and such lateral or second axis registration may be done upstream of the platen, as by confinement of the documents within the side guides in the document tray from which the documents are fed, or driving the sheet against a side guide, e.g. U.S. Pat. Nos. 4,257,587; 4,266,762 or 4,381,893.

In the description herein the term "document" or "sheet" refers to a usually flimsy sheet of paper, plastic, or other such conventional individual image substrate, and not to microfilm or electronic images which are generally much easier to manipulate. It is important to distinguish electronic copying systems, such as the Xerox "9700" printer, which read and store images of documents electronically and create copies by writing on a photoreceptor with a laser beam, or the like, since they do not have the problems dealt with here.

The "document" here is the sheet (original or previous copy) being copied in the copier onto the outputted "copy sheet", or "copy". Related plural sheets of documents or copies are referred to as a "set". A "simplex" document or copy sheet is one having an image and "page" on only one side or face of the sheet, whereas a "duplex" document or copy sheet has a "page", and normally an image, on both sides.

The present invention is particularly suitable for precollation copying, i.e. automatically plurally recirculated document set copying provided by a recirculating document handling system or "RDH". However, it also has applicability to nonprecollation, or postcollation, copying, such as postcollation operation of an RDH or semiautomatic document handling (SADH0) as discussed above. Postcollation copying, or even manual document placement, is desirable in certain copying situations, even with an RDH, to minimize document handling, particularly for delicate, valuable, thick or irregular documents, or for a very large number of copy sets. Thus, it is desirable that a document handler for a precollation copying system be compatible with, and alternatively usable for, postcollation and manual copying as well.

Some examples of Xerox Corporation RDH U.S. patents are U.S. Pat. Nos. 4,459,013 issued July 10, 1984 to T. J. Hamlin et al; 4,278,344 issued July 14, 1981 to R. B. Sahay; and 4,579,444, 325 or 326. Some other examples of recirculating document handlers are disclosed in U.S. Pat. Nos. 4,076,408; 4,176,945; 4,428,667; 4,330,197; 4,466,733 and 4,544,148. A preferred vacuum corrugating feeder air knife, and a tray, for an RDH, are disclosed in U.S. Pat. Nos. 4,418,905 and 4,462,586. An integral semi-automatic and computer form feeder (SADH/CFF), which may be an integral part of an RDH, as noted in Col. 2, paragraph 2, therein, is disclosed in U.S. Pat. No. 4,462,527. Various others of these patents, such as U.S. Pat. No. 4,176,945 above, issued Dec. 4, 1979 to R. Holzhauser (Kodak) teach plural mode, e.g. RDH/SADH, document handlers.

The present invention overcomes various of the above-discussed problems, and provides various of the above features and advantages.

A feature of the specific embodiment disclosed herein is to provide, In a recirculating document handler for repeatedly sequentially presenting documents to the platen of a copier for copying, comprising a document stacking and restacking tray spaced from the platen and adapted to receive for copying a set of documents loaded therein, first feeding means for feeding the documents from said stacking tray to the platen, second feeding means for feeding the documents over the platen for copying, and third feeding means for feeding the documents from said platen back to said stacking tray after they have been copied, to complete a document recirculation path, sensing means for sensing document jams and for sensing the position of jammed documents in said document recirculation path, and control means connecting with said sensing means and the copier for controlling the operation of said recirculating document handler, including stopping the recirculating document handler in response to sensing of a jam by said sensing means, said control means determining which documents had been copied before a jam occured and providing instructional displays to the operator for operator jam clearance (document removal) and job recovery, and wherein said recirculating document handler has an additional, separate, document input means for normally sequentially feeding documents to said platen to be copied other than documents from said stacking tray and other than for precollation copying, in a separate document feeding path; the improvement comprising an improved jam clearance and job recovery system for recovering from document jams in said recirculating document handler document recirculation path, wherein after said recirculating document handler has stopped in response to said sensing of a jam by said sensing means, said control means thereby determines whether a document jam has resulted in a jammed document being present in a first, second or third jam zone, wherein said first jam zone includes said first feeding means, said second jam zone includes said platen and said second feeding means, and said third jam zone includes said third feeding means; when said control means so determines that a document jam has resulted in a jammed document being present in said first or second jam zones, said control means automatically provides a first job recovery mode with a said instructional display to the operator instructing the operator to remove documents present in said first or second jam zones and to place those documents into said separate document input means, and said control means then automatically operates said recirculating document handler to feed those documents from said separate document input means onto said platen and to said stacking tray via said third feeding means, but wherein those documents in said second jam zone which had already been copied before said jam occured are fed across said platen without being copied; and other said documents from said first or second jam zones are copied; when said said control means so determines that a document jam has resulted in a jammed document being present in said third jam zone, said control means automatically provides a different job recovery mode with a different said instructional display to the operator instructing the operator to remove documents present in said third jam zone and either to to place those document into said stacking tray or to place those documents into said separate document input means, and said control means then automatically operates said recirculating document handler to feed those documents from said separate document input means past said platen and to said stacking tray via said third feeding means without copying them.

Further features provided by the system disclosed herein, individually or in combination include those wherein said control means controls said recirculating document handler to wait for the sensing of a document being fed into said separate document input means when a document jam has resulted in a jammed document being present in said first or second jam zones; wherein if said sensing means senses the lifting of the stack of documents in said stacking tray after said recirculating document handler has stopped in response to sensing of a jam, said control means provides a different said instructional display to the operator and differently controls said recirculating document handler to circulate the set of documents once through the document path, without copying, up to the document being copied when the jam occurred, and does not wait for the sensing of a document being fed into said separate document input means, when a document jam has resulted in a jammed document being present in said first or second jam zones; or wherein said first second and third feeding means are independently operable by said control means to provide for continued feeding of unjammed documents to said stacking tray or to said platen after said sensing of a jam by said sensing means, irrespective of where the jam was so sensed, so that said operator jam clearance is required and instructed in only one of said first, second or third jam zones.

Further features provided by the system disclosed herein, individually or in combination, include, in a copying method utilizing a recirculating document handler repeatedly sequentially presenting documents to the platen of a copier for copying, said recirculating document handler comprising a document stacking and restacking tray spaced from the platen and adapted to receive for copying a set of documents loaded therein, and first feeding means for feeding the documents from said stacking tray to the platen, and second feeding means for feeding the documents over the platen for copying, and third feeding means for feeding the documents from said platen back to said stacking tray after they have been copied, to complete a document recirculation path, and sensing means for sensing document jams and for sensing the position of jammed documents in said document recirculation path, and control means connecting with said sensing means and the copier for controlling the operation of said recirculating document handler, including stopping the recirculating document handler in response to sensing of a jam by said sensing means, said control means determining which documents had been copied before a jam occured and providing instructional displays to the operator for operator jam clearance (document removal) and job recovery, and wherein said recirculating document handler has an additional, separate, document input means for normally sequentially feeding documents to said platen to be copied other than documents from said stacking tray; the improvement comprising an improved jam clearance and job recovery method for recovering from document jams in said recirculating document handler document recirculation path, wherein: in response to said sensing of a jam by said sensing means, determining with said control means whether a document jam has resulted in a jammed document being present in a first, second, or third jam zone, wherein said first jam zone includes said first feeding means, said second jam zone includes said platen and said second feeding means, and said third jam zone includes said third feeding means; when said control means so determines that a document jam has resulted in a jammed document being present in said first, second or third jam zones, automatically providing a preliminary job recovery operation before said recirculating document handler is stopped and before said operator jam clearance and job recovery display, comprising correspondingly selectably independently operating said first second and third feeding means are operated to provide for feeding of unjammed documents in said third jam zone to said stacking tray and/or for feeding of unjammed documents in said first jam zone to said platen after said sensing of a jam by said sensing means; and then instructing and accomplishing said operator jam clearance of documents from said document feeding path in only one of said first, second or third jam zones; and wherein after said preliminary job recovery operation has been accomplished, the operator is instructed to place certain documents so removed from said document feeding path in said jam clearance face up in said stacking tray, and instructed to place other said documents so removed from said document feeding path face down in said separate document input means, depending on said determination of whether said document jam was present in said first, second or third jam zones, and the copier is restarted for job completion without manual document reordering.

Some examples of various other prior art copiers with document handlers, and especially with control systems therefor, including document sheet detecting switches, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in this art, and in general, how to program and execute document handler and copier control functions and logic with conventional or simple software instructions for conventional microprocessors. This is taught by the above and other patents and various commercial copiers. Such software may vary depending on the particular function and particular microprocessor or microcomputer system utilized, of course, but will be available to or readily programmable by those skilled in the applicable arts without experimentation from either descriptions or prior knowledge of the desired functions together with general knowledge in the general software and computer arts. It is also known that conventional or specified document handling functions and controls may be alternatively conventionally provided utilizing various other known or suitable logic or switching systems.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below. The present invention will be better understood by reference to this description of this embodiment thereof, including the drawing figures (approximately to scale), wherein:

FIG. 1 is a side view of an exemplary document handler for a copier, incorporating the system of the invention (in this example, the DH is a single integral plural mode RDH (Simplex/Duplex/SADH/CFF).

Describing now in further detail the specific example illustrated in the Figure, there is partially schematically shown an exemplary copier 10, with an exemplary document handling system 20 (preferably a plural mode RDH, to be described herein) The copier 10 may be of any known type, such as those respectively disclosed in above-cited copier patents. The exemplary DH 20 illustrated here is similar to that shown in the above cross-referenced U.S. Ser. No. 029,027, or the generally comparable disclosures in U.S. Ser. No. 029,026, both filed Mar. 23, 1987. However the jam clearance and the job recovery system disclosed herein is equally applicable to various other DH's, especialy dual input DH's such as those shown in various above cited patents thereon such as U.S. Pat. No. 4,579,444, etc. . . . As shown therein, it is previously known to have two separate document inputs, a recirculating or RDH input stacking tray 21, and a side entrance 22 for semiautomatic document handling (SADH), into which documents may be individually inserted by the operator, sequentially and/or in an operator selected "job interupt" mode.

The RDH 20 provides for automatically transporting individual registered and spaced document sheets onto and over the conventional platen imaging station 23 of the copier 10, using a belt transport 32 overlying the platen 23. Documents are inputted to one end of the platen transport 32 either from the RDH input provided by the restacking tray 21 on top of the unit, spaced above the platen, or from the seperate document input 22 directly adjacent one side of the platen, shown at the right side here. That second input 22 is referred to herein as the "slot" or SADH input 22, although it is not limited to semiautomatic input feeding. This SADH input 22 may be used for larger documents, optionally inserted short edge first, or CF web, or an automatic document stack stack feeder (ADF).

The particular DH system shown 20 here has the additional ability to do mid form CF starts at any desired panel of a CF web. It can do this because when the DH unit is opened the feed roll nips at opposite sides of the platen fully open, with the drivers lifting up with the platen cover unit 25 and the idlers unconventionally remaining on or below the copier 10 surface, and the operator has full access to the platen 23.

As is conventially practiced, the entire document handler unit 20 pivotally mounts to the coper so as to be liftable by the operator up away form the platen for manual document placement and copying or jam clearance of documents jammed in the platen area. The DH 20 has conventional external covers (not shown, for drawing clairity). Preferably and conventionally there are seperate right and left hand cover sections which are pivotably liftable by the operator to provide access to the document paths at the right and left ends of the DH 20.

Other than the DH 20 document system modifications and controls and other features to be described herein, the exemplary copier 10 may be, for example, the well known "Xerox" "1075" or "1090" or any other xerographic or other copier, as illustrated and described in various patents cited above and otherwise, including U.S. Pat. No. 4,278,344 and others. The exemplary copier 10 may conventionally include a photoreceptor belt 12 and the conventional xerographic stations acting thereon for respectively charging, image exposing at 14, image developing, etc. Documents on the platen 23 may be imaged onto the photoreceptor 12 at area 14 through a variable reduction ratio optical imaging system 16 to fit the document images to the selected size of copy sheets. The copier 10 is preferably adapted in a known manner to provide duplex or simplex precollated or postcollated copy sets from either duplex or simplex original documents copied from the RDH 20.

The control of all sheet feeding is, conventionally, by the machine controller 100. The controller 100 is preferably a known programmable microprocessor, exemplified by the previously cited art. The controller 100 conventionally controls all of the machine steps and functions described herein including the operation of the document feeder 20, the document and copy sheet gates, the feeder drives, etc. As further taught in those references, the controller 100 also conventionally provides for storage and comparison of the counts of the copy sheets, the number of documents recirculated in a document set, the desired number of copy sets and other selections by the operator through the panel of switches thereon, time delays, jam correction control, etc. The controller 100 may be conventionally connected to receive jam and control signals from various conventional document sheet sensors mounted in the document recirculation path of the RDH, including those shown in the respective locations shown here in the Figure, of which 39, 52, 55, 56, and 57 will be noted further herein.

Referring further to the exemplary plural mode document handling system 20 illustrated in FIG. 1, it may be seen that documents may be fed to the same platen 23 and platen transport 32 input position from either the SADH input 22, or from the RDH tray 21. The latter input is through an RDH input path 24 between that tray 21 and the upstream end of the the platen transport 32, preferably including, as shown, a known stack feeder/seperator, a sensor 52, and a first set of turn baffles and feed rollers to invert the documents before copying. The SADH input 22 may conventionally include a tray and edge guide and sensors and an SADH preregistration gate 30. This gate 30 may have any of the various configurations and operating mechanisms illustrated in various of the above-noted prior art references on registration gate systems. The gate 30 illustrated here is preferably retractable in and out of the SADH input path to the platen from the SADH input 22 by solenoid actuation controlled by the controller 100. The SADH input path feds in documents directly to the platen, without inversion, and bypassing, without interference, the RDH input path 24, so that the two inputs can automatically operate in a selected interleaved or interrupt feeding sequence.

The SADH input 22 here preferably also includes slightly skewed cross-rollers 26. As taught in the above-cited U.S. Pat. No. 4,579,444, these provide side edge registration towards a rear edge guide at this input, as well as feeding of the document forward for registration and deskewing against the gate 30. Such cross-rollers may also be provided in the RDH input path 24. Just downstream of the gate 30 are take-away or on-platen rollers 28 providing a document sheet feeding nip for engaging and transporting any document sheet which is past the gate 30 or the RDH input path 24. The rollers 38 feed the documents directly past sensor 28 into the input to the platen transport system 32. Preferably the platen transport system 32 here comprises plural vacuum belts for engaging and transporting the documents without slippage over the platen 23 into the desired registration position, of the general type disclosed in U.S. Pat. No. 4,618,138, etc. The platen transport system 32 and the rollers 28 may be incrementally servo motor driven by the controller 100 in a manner taught by various of the above-cited references.

After the documents are copied on the platen 23, they are, in this example, ejected by the platen transport system 32 into downstream or offplaten rollers 34 and fed past a gravity gate 37 and sensor 39 to a decision gate 36. If the gate 36 is up (it always is for CF or normall SADH copying) it deflects the documents directly to an SADH document output including output rollers 38. If the decision gate 36 is down, as for RDH, and for job recovery here, sheet documents are deflected into an RDH return path 40, past sensor 55. However, this RDH return path 40 includes reversible rollers 42 to provide a choice of two return paths to the RDH tray 21; a simplex return path 44 with an inversion, or a duplex return path 46 without an inversion. For the duplex path 46 the rollers 42 are reversed to reverse feed the previous trail edge of the sheet back to the now-dropped gate 37 which now deflects that sheet into the path 46. The duplex return path 46 provides a desired circulation inversion of duplex documents, as returned to the tray 21, for copying their opposite sides in a subsequent circulation, or circulations, as described in the above-cited art. This is because a duplex document returned through the duplex return path 46 has only one inversion per circulation (in the RDH input path 24). In contrast, in the complete simplex circulation path there are two inversions per circulation, one in each of the paths 24 and 44, which equals no inversion per circulation. Thus, simplex documents are always returned to tray 21 in their original, face up, orientation.

It will be seen that the respective document paths and the tray 21 include various sensors for counting and/or sensing the lead edge and/or trail edge of the document sheets. These sensors are schematically illustrated here by the conventional representation of an arrowhead or triangle. All of these sensors are, of course, conventionally connected to the controller 100 to be utilized in the operation of the DH system 20.

As illustrated, the RDH tray 21 here also includes a variable position near registration edge or backstop, illustrated here with several dashed lines, for initially accommodating and restacking various sizes of documents. The illustrated DH system 20 utilizes for its RDH feeding a known combined corrugated vacuum feeding and air knife separator system for feeding out sequentially the bottom-most sheet of the stack in the tray 21, as described in various of the above-cited references.

As noted, the SADH input 22 path includes side (rear edge) registering cross-rollers 26. This same SADH input 22 is normally desirably commonly used here for CF web input also, since it provides for basically planar or straight through web feeding of CF web, and can utilize these same cross-rollers 26, but rollers 28 and 34 may be disabled, as shown by their dashed line positions. For normal cut sheet SADH input 22 document feeding in the DH system 20, the documents are fed and controlled by, in order, the cross-rollers 26, the nips of the on-roll rollers 28, the platen vacuum belt transport 32, the nips of the downstream or off-roll rollers 34, and then the nips of the output or exit roll rollers 38. For RDH circulation the sheets are additionally driven and controlled by the stack feeder/seperator and the rollers and curved baffles in the paths 24 and 44 or 46, and the eject rollers at the restack entrance at the rear of the tray 21, as illustrated. Individual sheets are "handed off" from one feeding nip to another along the document path with very restricted slippage to ensure positive and registered feeding. All of these latter nips and baffles are preferably and conventionally designed to open for jam clearance access and sheet removal when their respective DH 20 covers are opened.

In the system illustrated here, the portions of all the roller pair units 26, 28, 34 and 38 which are below the document path are idler rollers mounted to the body of the copier. All the above-path rollers in each of these nip pairs are the driven rollers, and all of those mounted to the pivotal platen cover unit of the DH system 20. Thus, these above-path rollers may all be lifted up, away from the plate 23, to expose it and to open all these roller nips and the platen transport 32.

Furthermore, as noted, the below-path idlers of the rollers 28 and 34 are desirably movable by motor/cam or solenoid retractors to the dashedline positions shown, so as to open those nips for CFF even when the DH system 20 is pivoted down into its closed, operating, position. This opening of the on-roll 28 and off-roll 34 nips is done automatically as part of the CFF mode of operation, and can also be done temporarily after a jam is detected in normal RDH or SADH operation to assist jam clearance.

Turning now to details of the exemplary system disclosed herein, there is disclosed a simplified method of document jam clearance and job recovery for a document handler for copier, with features as previously described above in the introduction. Specifically, there is provided a system and method for jam clearance and job recovery in a recirculating document handler provided with an SADH document input chute and distributed drives. The jammed document and all documents in the jam area may be stopped while all documents downstream proceed to completion of their cycles, and are normally ejected into the RDH tray to restack. The jammed document is cleared by the operator and returned to either the SADH or RDH tray input, as directed. The machine then takes over to finish the job. No removal or reordering of the document set is required. This disclosed system and method utilizes the separate SADH input for the RDH document handler, independent jam sensors distributed along the document recirculation path, and separate, independently actuatable, drives respectively independently driving the input feeder from the RDH tray, the platen transport, the document inverter, the document restack transport to the RDH tray, and associated document feed rollers in the document path. Preferably there are three such independently operable or distributed drive areas of the RDH 20, corresponding to 3 jam zones, zones 1, 2 and 3, to be described hereinbelow. The first jam zone includes a first feeding sub-system driving the illustrated feeder/seperator and feed rollers in the path 24. The second jam zone includes the platen 23 area with the platen transport 32 comprising a second feeding sub-system. The third jam zone includes a third feeding sub-system driving the feed rollers in the paths 44 and 46. Since all these system drives preferably comprise conventional or known motors and/or clutches, only the feed path portions thereof are illustrated here.

When one of the jam sensors senses a jam in its particular area or zone of the document path, the motor driving the document in that zone is automatically turned off to prevent damage to that document. However, the document drive motors downstream thereof in the document path continue to run if there is no jam in those areas, so as to enable returning the downstream, unjammed document sheets back to restack in the RDH tray even after a jam is declared. Likewise a jam in paths 44 or 46 need not prevent a document already at least partially in path 24 from being desirably fed onto the platen after a jam declaration and copied, and then left there for easier removal than from path 24 itself.

The operator is then selectively instructed by a variable known control panel display, such as a verbal and pictoral CRT or liquid crystal screen display, to manually remove the jammed document sheet and any other sheets left in the document path from their final stopped positions and to differently treat the removed document or documents depending on the operating condition and jam condition. That is, the operator may be instructed by the display to either place the removed document(s) face down in the SADH input (the RDH slot) 22 rather than the RDH document tray under certain said defined conditions, or to place them in the RDH tray 21 for other defined conditions.

The copier then automatically goes into a job recovery mode, in which at the appropriate time the previously jammed document now in the SADH input is now fed into the document path and fed therethrough to restack on top of the stack. This will normally be immediately after the jam condition is removed, i.e., after the controller determines that the jam is "cleared". The job recovery logic mode will also automatically decide whether or not to copy that document, and whether or not to invert it, depending on the previously selected mode of operation and the location of the jam.

This saves considerable operator time in job recovery. The operator no longer has to remove the stack and manually reorder the originals, and then wait for the document handler to recirculate the documents without copying until the correct original is back on the platen, in order to recover from the jam and maintain collated output.

The job recovery and jam clearance system disclosed herein has the ability to deliver different job recovery messages, instructions and routines to suit the needs of the particular operating mode for the job that is being run, and the circulation that is being run within the job when a jam occurs. E.g., recovery from duplex to duplex copying jams is handled different than for simplex to duplex, and within duplex to duplex it is different for an inverting versus a non-inverting circulation. Moreover, the system handles jams occurring in both SADH slot feed and CFF modes through the additional separate input 22 provided for that.

As indicated, regardless of the type of jam or where it occurs (or is "declared" by the sensors and connecting logic), there is normally only one zone for the operator to clear, because non-jammed documents downstream of the jam location and platen and already copied are automatically fed back to the RDH tray 21, and non-jammed documents upstream of the jam area and platen may be brought on to the platen and stopped for imaging thereon. As indicated, this is enabled by the use of separate or separately engagable drives for the platen transport, the upstream or zone one feed rollers, and the downstream or zone three feed rollers, all referred to herein as a "distributed drive" system. These drives can be shut down at different times, so as to continue to feed non-jammed documents after a jam but not to drive, or attempt to drive and damage, jammed documents in a jam zone. The document sheet drive in the jam area can be shut down immediately.

It should be noted that for practical purposes, there are only a maximum of two document sheets in the document recirculation path at any one time. Thus normally only one or two document sheets need be operator removed from the document path with the system here, and in some cases none.

There are basically five basic types of jams and their respective automatically instructed clearance and recovery modes disclosed herein, summarized below as follows:

1. Misfeeds in the RDH tray 21 or its exit (document fails to reach sensor 52 in time after feeder actuated): unload tray, fluff stack, return stack to tray 21 and restart. If the misfeed is not on the first feed (the first document in the set), an automatic reorder and recirculation follows before copying restarts, to automatically recirculate to the proper document and to correctly reset the stack set seperator, etc.. This mode is automatically triggered by the logic having noted the document stack being lifted out of the stack (a tray empty signal) and reinserted into the stack. [Note that before the RDH shuts down and the display directs this clearance and recovery that all documents in the document path are automatically fed through and returned to the RDH tray.] [Also note that any partially completed copy sets may have to be removed from the copier output.]

2. Zone 1 jams (comprising input turn path jams from about sensor 52 to sensor 57): Open right cover, remove document sheet, close cover, insert that sheet into SADH slot 22 face down. Machine feeds that sheet to the platen 23 and flashes it if required. After flashing, it returns that sheet to the tray 21 and automatically continues with the job. No reorder or recirculation is required. [If more than one document is removed, may require restart as in 1. above.]

3. Zone 2 jams (comprising platen region jams from about sensor 57 to sensor 39): Open DH unit 20 (exposing platen), remove sheet or sheets, close DH. Feed removed sheet or sheets into SADH slot 22 face down. Machine will feed sheet to the platen and flash if required, i.e., with or without copying depending on the jam. After flashing or slew feed the sheet is returned to the tray 21 (normally via path 44 but with inversion via path 46 if it was a duplex document in an inversion circulation) and the machine continues with the job. No reorder or recirculation is required. [If more than two documents are removed, may require restart as in 1. above.]

4. Zone 3 jams (comprising return turn jams from about sensor 39 to the tray 21 entrance—note sensor 56): If a second (the following) sheet has not been committed into zone 1, open left cover, remove sheet, close cover, place sheet on top of stack in tray 21 face up and restart. If a second sheet has already been committed into zone 1 (fed out of the tray) at that time, open left cover, remove sheet, close cover, place sheet on top of stack in tray 21 face up, then open DH and remove second sheet from platen (where it has been automatically fed as described above), close DH, feed this sheet into SADH slot 22 face down, and the machine then feeds it to the platen and then back to the RDH tray 21. As in 3 above, a duplex document sheet may or not not require inversion via the return inverter (duplex) path 44, depending on the operating mode, and here also depending on the jam location, and this is automatically provided. No reorder or recirculation is required.

5. Multifeeds (sensed sheet count error): After the machine stops and all originals have been delivered back to the RDH tray, remove all originals, re-order and place them back into the tray in normal, face up, loading orientation, press START and continue with the job.

It will be additionally noted that the SADH slot 22 can also be used in a known operator button selected "job interrupt" mode, after the jam is cleared but before job recovery is initiated, to interrupt to remake a damaged original (make an undamaged copy which will recirculate properly) without disturbing the set in the document tray.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a recirculating document handler for repeatedly sequentially presenting documents to the platen of a copier for copying, comprising a document stacking and restacking tray spaced from the platen and adapted to receive for copying a set of documents loaded therein, first feeding means for feeding the documents from said stacking tray to the platen, second feeding means for feeding the documents over the platen for copying, and third feeding means for feeding the documents from said platen back to said stacking tray after they have been copied, to complete a document recirculation path, sensing means for sensing document jams and for sensing the position of jammed documents in said document recirculation path, and control means connecting with said sensing means and the copier for controlling the operation of said recirculating document handler, including stopping the recirculating document handler in response to sensing of a jam by said sensing means, said control means determining which documents had been copied before a jam occured and providing instructional displays to the operator for operator jam clearance (document removal) and job recovery, and wherein said recirculating document handler has an additional, separate, document input means for normally sequentially feeding documents to said platen to be copied other than documents from said stacking tray and other than for precollation copying, in a seperate document feeding path; the improvement comprising an improved jam clearance and job recovery system for recovering from document jams in said recirculating document handler document recirculation path, wherein:

after said recirculating document handler has stopped in response to said sensing of a jam by said sensing means, said control means thereby determines whether a document jam has resulted in a jammed document being present in a first, second or third jam zone, wherein said first jam zone includes said first feeding means, said second jam zone includes said platen and said second feeding means, and said third jam zone includes said third feeding means;

when said control means so determines that a document jam has resulted in a jammed document being present in said first or second jam zones, said control means automatically provides a first job recovery mode with a said instructional display to the operator instructing the operator to remove documents present in said first or second jam zones and to place those documents into said separate document input means, and said control means then automatically operates said recirculating document handler to feed those documents from said seperate document input means onto said platen and to said stacking tray via said third feeding means, but wherein those documents in said second jam zone which had already been copied before said jam occured are fed across said platen without being copied, and other said documents from said first or second jam zones are copied;

when said said control means so determines that a document jam has resulted in a jammed document being present in said third jam zone, said control means automatically provides a different job recovery mode with a different said instructional display to the operator instructing the operator to remove documents present in said third jam zone and either to to place those document into said stacking tray or to place those documents into said separate document input means, and said control means then automatically operates said recirculating document handler to feed those documents from said separate document input means past said platen and to said stacking tray via said third feeding means without copying them.

2. The recirculating document handler job recovery system of claim 1 wherein said control means controls said recirculating document handler to wait for the sensing of a document being fed into said separate document input means when a document jam has resulted in a jammed document being present in said first or second jam zones.

3. The recirculating document handler job recovery system of claim 1 wherein if said sensing means senses the lifting of the stack of documents in said stacking tray after said recirculating document handler has stopped in response to sensing of a jam, said control means provides a different said instructional display to the operator and differently controls said recirculating document handler to circulate the set of documents once through the document path, without copying, up to the document being copied when the jam occurred, and does not wait for the sensing of a document being fed into said separate document input means, when a document jam has resulted in a jammed document being present in said first or second jam zones.

4. The recirculating document handler job recovery system of claim 1 wherein said first second and third feeding means are independently operable by said control means to provide for continued feeding of unjammed documents to said stacking tray or to said platen after said sensing of a jam by said sensing means, irrespective of where the jam was so sensed, so that said operator jam clearance is required and instructed in only one of said first, second or third jam zones.

5. In a recirculating document handler for repeatedly sequentially presenting documents to the platen of a copier for copying, comprising a document stacking and restacking tray spaced from the platen and adapted to receive for copying a set of documents loaded therein, first feeding means for feeding the documents from said stacking tray to the platen, second feeding means for feeding the documents over the platen for copying, and third feeding means for feeding the documents from said platen back to said stacking tray after they have been copied, to complete a document recirculation path, sensing means for sensing document jams and for sensing the position of jammed documents in said document recirculation path, and control means connecting with said sensing means and the copier for controlling the operation of said recirculating document handler, including stopping the recirculating document handler in response to sensing of a jam by said sensing means, said control means determining which documents had been copied before a jam occured and providing instructional displays to the operator for operator jam clearance (document removal) and job recovery, and wherein said recirculating document handler has an additional, separate, document input means for normally sequentially feeding documents to said platen to be copied other than documents from said stacking tray and other than for precollation copying, in a separate document feeding path; the improvement comprising an improved jam clearance and job recovery system for recovering from document jams in said recirculating document handler document recirculation path, wherein:

in response to said sensing of a jam by said sensing means, said control means thereby determines whether a document jam has resulted in a jammed document being present in a first, second or third jam zone, wherein said first jam zone includes said first feeding means, said second jam zone includes said platen and said second feeding means, and said third jam zone includes said third feeding means;

when said control means so determines that a document jam has resulted in a jammed document being present in said first, second or third jam zones, said control means first automatically provides a preliminary job recovery operation before said recirculating document handler is stopped and before said operator jam clearance and job recovery display, wherein said first second and third feeding means are correspondingly selectably independently operated by said control means to provide for feeding of unjammed documents in said third jam zone to said stacking tray and/or for feeding of unjammed documents in said first jam zone to said platen after said sensing of a jam by said sensing means, so that said operator jam clearance is required and instructed in only one of said first, second or third jam zones.

6. In a copying method utilizing a recirculating document handler repeatedly sequentially presenting documents to the platen of a copier for copying, said recirculating document handler comprising a document stacking and restacking tray spaced from the platen and adapted to receive for copying a set of documents loaded therein, and first feeding means for feeding the documents from said stacking tray to the platen, and second feeding means for feeding the documents over the platen for copying, and third feeding means for feeding the documents from said platen back to said stacking tray after they have been copied, to complete a document recirculation path, and sensing means for sensing document jams and for sensing the position of jammed documents in said document recirculation path, and control means connecting with said sensing means and the copier for controlling the operation of said recirculating document handler, including stopping the recirculating document handler in response to sensing of a jam by said sensing means, said control means determining which documents had been copied before a jam occured and providing instructional displays to the operator for operator jam clearance (document removal) and job recovery, and wherein said recirculating document handler has an additional, separate, document input means for normally sequentially feeding documents to said platen to be copied other than documents from said stacking tray; the improvement comprising an improved jam clearance and job recovery method for recovering from document jams in said recirculating document handler document recirculation path, wherein:

in response to said sensing of a jam by said sensing means, determining with said control means whether a document jam has resulted in a jammed document being present in a first, second, or third jam zone, wherein said first jam zone includes said first feeding means, said second jam zone includes said platen and said second feeding means, and said third jam zone includes said third feeding means;

when said control means so determines that a document jam has resulted in a jammed document being present in said first, second or third jam zones, automatically providing a preliminary job recovery operation before said recirculating document handler is stopped and before said operator jam clearance and job recovery display, comprising correspondingly selectably independently operating said first second and third feeding means are operated to provide for feeding of unjammed documents in said third jam zone to said stacking tray and/or for feeding of unjammed documents in said first jam zone to said platen after said sensing of a jam by said sensing means;

and then instructing and accomplishing said operator jam clearance of documents from said document feeding path in only one of said first, second or third jam zones.

7. The copying method of claim 6 wherein said preliminary job recovery operation has been accomplished, the operator is instructed to place certain documents so removed from said document feeding path in said jam clearance face up in said stacking tray, and instructed to place other said documents so removed from said document feeding path face down in said separate document input means, depending on said determination of whether said document jam was present in said first, second or third jam zones, and the copier is restarted for job completion without manual document reordering.

* * * * *